US005522322A

United States Patent [19]

Warren et al.

[11] Patent Number: 5,522,322

[45] **Date of Patent: *Jun. 4, 1996**

[54] MOTORIZED SYSTEM AND METHOD FOR AIDING PHYSICALLY-IMPAIRED PERSONS IN MOVING BETWEEN DIFFERENT POSITIONS

[75] Inventors: Robert C. Warren, P.O. Box 671, Eastsound, Wash. 98245; Stanley F. Farmer, Battle Ground, Wash.; Glenn E. Herz, Portland, Oreg.

[73] Assignee: Robert C. Warren, Eastsound, Wash.

[ * ] Notice: The term of this patent shall not extend beyond the expiration date of Pat. No. 5,269,227.

[21] Appl. No.: 223,495

[22] Filed: Apr. 5, 1994

Related U.S. Application Data

[60] Continuation-in-part of Ser. No. 99,169, Jul. 29, 1993, Pat. No. 5,363,771, which is a division of Ser. No. 860,971, Mar. 31, 1992, Pat. No. 5,269,227.

[51] Int. Cl.[6] ..... B61C 11/04

[52] U.S. Cl. ..... 105/29.1; 104/89; 105/148; 187/201; 280/667; 5/81.1 R

[58] Field of Search ..... 104/89, 93, 94, 104/307; 105/26.05, 29.1, 127, 148, 150, 463.1; 187/7, 12; 280/250.1, 304.1; 4/667, 564.1, 565.1, 566.1; 5/81.1, 83.1, 84.1, 86.1

[56] References Cited

U.S. PATENT DOCUMENTS

| | | | |
|---|---|---|---|
| 3,336,877 | 8/1967 | O'Donnell | 104/93 |
| 3,573,877 | 4/1971 | Locke | 280/5.32 |
| 3,583,322 | 6/1971 | Vykukal | 104/139 |
| 3,591,874 | 7/1971 | O'Kennedy | 5/81 |
| 3,592,282 | 7/1971 | Soileau | 180/8.2 |
| 3,638,647 | 2/1972 | Creelman | 128/133 |
| 3,747,538 | 7/1973 | Giraud | 104/105 |
| 3,780,663 | 12/1973 | Pettit | 104/91 |

(List continued on next page.)

FOREIGN PATENT DOCUMENTS

| | | | |
|---|---|---|---|
| 244030 | 11/1987 | European Pat. Off. | 187/12 |
| 2517287 | 6/1983 | France . | |
| 49785 | 8/1966 | German Dem. Rep. . | |
| 3128046 | 2/1983 | Germany . | |
| 3222114 | 12/1983 | Germany . | |
| 3307488 | 9/1984 | Germany | 104/89 |
| 8710943 | 12/1987 | Germany . | |
| 8217206 | 1/1988 | Germany . | |
| 3934431 | 4/1991 | Germany . | |
| 58-20271 | 2/1983 | Japan . | |
| 60-43678 | 3/1985 | Japan . | |
| 158584 | 4/1989 | Japan . | |
| 1229760 | 9/1989 | Japan | 104/93 |
| 361278 | 3/1991 | Japan . | |
| 464585 | 2/1992 | Japan . | |
| 2106790 | 4/1983 | United Kingdom . | |

OTHER PUBLICATIONS

LIFTA Treppenlifte brochure (undated) published by LIFTA GmbH of Cologne, Germany.

HIRO LIFT brochure (undated) published by Hillenkotter & Ronsieck GmbH of Bielefeld, Germany.

*Primary Examiner*—Robert J. Oberleitner
*Assistant Examiner*—S. Joseph Morano
*Attorney, Agent, or Firm*—Chernoff, Vilhauer, McClung & Stenzel

[57] ABSTRACT

A system and method for aiding physically-impaired persons in moving between different positions employs a longitudinally-extending elongate track, an upper body support assembly movably mounted on the track, and a motor for driving the support assembly along the track. The support assembly, which preferably comprises a handgrip extending transversely from the track, can be placed adjacent a toilet, chair, bathtub or bed to aid a disabled person in rising or seating himself. Preferably, the support assembly is selectively detachable from the track and transferable matingly to another such track or tracks located elsewhere for similar purposes, or to a similar but longer track located alongside a stairway or level surface such as a hallway.

17 Claims, 6 Drawing Sheets

U.S. PATENT DOCUMENTS

| | | | |
|---|---|---|---|
| 3,985,082 | 10/1976 | Barac | 104/89 |
| 4,031,576 | 6/1977 | Epstein | 4/667 |
| 4,144,597 | 3/1979 | Guenther et al. | 4/254 |
| 4,168,552 | 9/1979 | Austin | 4/237 |
| 4,234,010 | 11/1980 | Marshall | 104/89 |
| 4,252,063 | 2/1981 | Brooks, Jr. | 104/89 |
| 4,253,287 | 3/1981 | Overmoe | 52/184 |
| 4,254,517 | 3/1981 | Herman, Jr. | 4/564 |
| 4,299,321 | 11/1981 | Hermawan | 198/321 |
| 4,326,622 | 4/1982 | Ellzey | 280/304.1 |
| 4,437,196 | 3/1984 | Louis | 4/564 |
| 4,445,502 | 5/1984 | Swan et al. | 104/89 |
| 4,564,086 | 1/1986 | Kingston | 187/12 |
| 4,569,094 | 2/1986 | Hart et al. | 5/86 |
| 4,602,567 | 7/1986 | Hedström | 105/153 |
| 4,904,916 | 2/1990 | Gisske et al. | 318/649 |
| 4,913,264 | 4/1990 | Voves et al. | 187/12 |
| 4,918,771 | 4/1990 | James | 5/83 |
| 4,948,156 | 8/1990 | Fortner | 280/304.1 |
| 4,996,728 | 3/1991 | Nolan | 4/496 |
| 5,022,106 | 6/1991 | Richards | 5/86 |
| 5,050,504 | 9/1991 | Mulcaster | 104/242 |
| 5,050,708 | 9/1991 | Wood | 187/12 |
| 5,052,521 | 10/1991 | Wendt et al. | 187/12 |
| 5,161,668 | 11/1992 | Datema et al. | 198/332 |
| 5,235,711 | 8/1993 | Jandrakovic | 5/81.1 |
| 5,269,227 | 12/1993 | Warren et al. | 105/29.1 |

MOTORIZED SYSTEM AND METHOD FOR AIDING PHYSICALLY-IMPAIRED PERSONS IN MOVING BETWEEN DIFFERENT POSITIONS

CROSS-REFERENCE TO RELATED APPLICATIONS

This application is a continuation-in-part of copending application Ser. No. 08/099,169, filed Jul. 29, 1993, now U.S. Pat. No. 5,363,771, which is a division of application Ser. No. 07/860,971, filed Mar. 31, 1992, now U.S. Pat. No. 5,269,227.

BACKGROUND OF THE INVENTION

The present invention relates to a system for aiding physically-impaired or disabled persons in moving between different positions, such as between a seated and a standing position relative to a toilet, chair, bathtub, bed or the like, or in ascending and descending stair-ways, and/or in traversing level surfaces such as hallways. Preferably, the system has multi-use versatility with respect to such activities.

Physically-impaired persons having limited mobility often encounter great difficulty in moving between a seated and a standing position, and particularly in doing so safely without falling forward. Yet such movement is necessary for performing the most basic activities of daily living such as eating, toileting, dressing, bathing and transferring in and out of bed. Many different types of devices for aiding persons in at least some of these activities have been developed in the past, as exemplified by the following U.S. patents:

U.S. Pat. No. 3,591,874
U.S. Pat. No. 3,638,647
U.S. Pat. No. 4,144,597
U.S. Pat. No. 4,168,552
U.S. Pat. No. 4,254,517
U.S. Pat. No. 4,437,196
U.S. Pat. No. 4,569,094
U.S. Pat. No. 4,918,771
U.S. Pat. No. 4,948,156
U.S. Pat. No. 4,996,728
U.S. Pat. No. 5,022,106
U.S. Pat. No. 5,235,711.

The drawbacks of such devices are that they are generally expensive and yet unsuitable, due to their bulk and/or mechanical structure, for aiding person in all of the different types of rising and seating activities necessary to daily living. For example, such devices designed to assist a person in rising from a chair or a toilet would normally not be readily adaptable for both purposes, nor for aiding the same person in rising from a bathtub.

Moreover, none of such devices would be adaptable for also aiding the person in ascending or descending a stairway or in traversing level surfaces such as a hallway. Entirely different types of devices have been designed for these purposes, as exemplified by U.S. Pat. Nos. 3,985,082, 4,253,287 and 4,445,502, British Patent Publication No. 2,106,790, German Patent Publication No. DE3934431, and German Utility Models G8710943.3 and G8217206.4.

Accordingly, if a disabled person with a mobility problem is to remain in his or her home, as opposed to a special care facility, the normal necessities of daily living require numerous such devices of different types which unfortunately are prohibitively expensive for many disabled persons. Nevertheless, allowing disabled persons to remain in their homes has historically been proven to involve the lowest overall cost and the highest therapeutic value to the patient.

Accordingly, what is needed is a multi-use system for aiding disabled persons in moving between a seated and a standing position for purposes of most or all of the above-described normal daily activities, which is preferably also adapted for aiding such persons in ascending and descending stairways and/or traversing level surfaces, and which is significantly less expensive than a combination of currently available different systems, each capable of performing only some of these functions.

SUMMARY OF THE PRESENT INVENTION

The present invention satisfies the foregoing needs by providing a system employing an elongate track, an upper body support assembly movably mounted on the track, and a motor for driving the support assembly along the track while supporting the upper body as the person moves between different positions, such as between a seated and a standing position, or while ascending or descending a stairway, or while traversing a level surface such as a hallway.

The track may be easily mounted on a wall or compact stand alongside virtually any device which might normally support the person in a seated position, such as a toilet, chair, bathtub, bed or the like, with the upper body support assembly extending transversely therefrom, preferably in the form of a handgrip. Alternatively, a longer but comparable track may be mounted alongside a stairway or level surface.

In accordance with one major aspect of the invention, the upper body support assembly can be disengaged from the track, carried portably to another comparable track located elsewhere, and matingly engaged with the other track for use in the other location. The multi-use portable transferability of the upper body support assembly between multiple tracks in different locations significantly reduces the expense which would otherwise be required for duplicative complete systems in the different locations.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

FIGS. 1, 2, 3, 4 and 4A show five different preferred embodiments of a system in accordance with the present invention. Each of the embodiments comprises a portable motorized upper body support assembly, designated generally as 12, for detachably engaging a track assembly 10, 10*a*, 10*b*, 10*c* or 10*d*, respectively. In each case the track assembly extends longitudinally alongside the person utilizing the system, preferably with a hand-grip 44 extending transversely from the respective track assembly in cantilevered fashion. Alternative upper body support assemblies 12 could, within the scope of the invention, include elbow, forearm, upper arm, torso or other appropriate support assemblies instead of, or in addition to, the handgrip support assembly 12.

Figure 4:
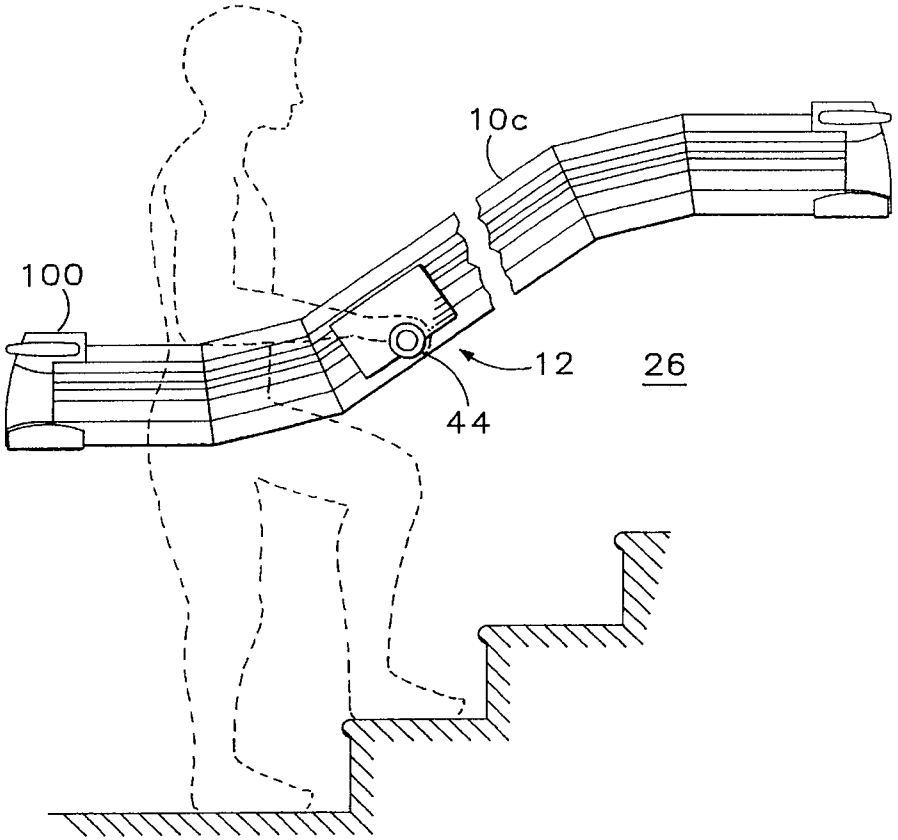
FIG. 4 is a side view of a still further embodiment of the invention for aiding a person in ascending or descending a stairway.
Figure 3:
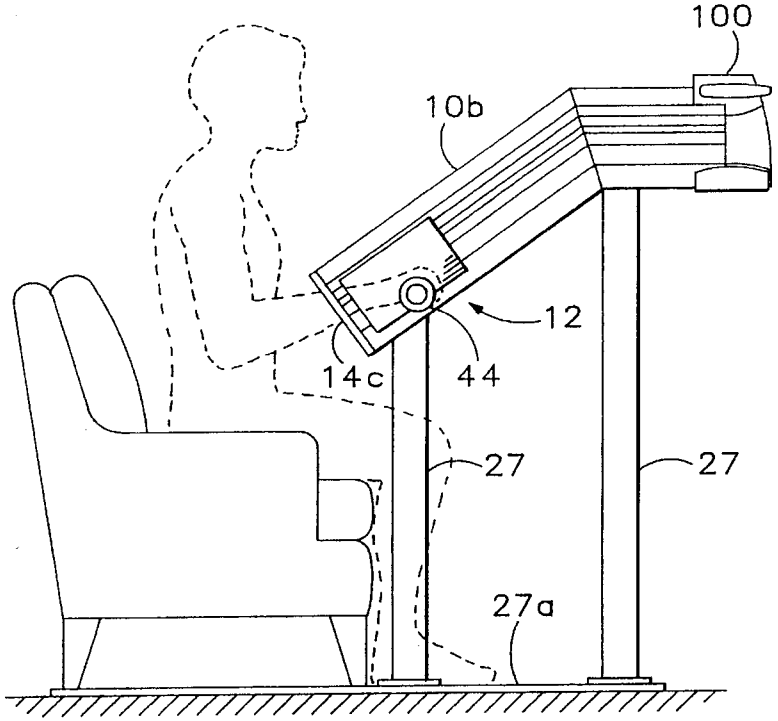
FIG. 3 is a side view of a further embodiment of the invention for aiding a person in moving between a seated and a standing position relative to a chair.
Figure 4A:
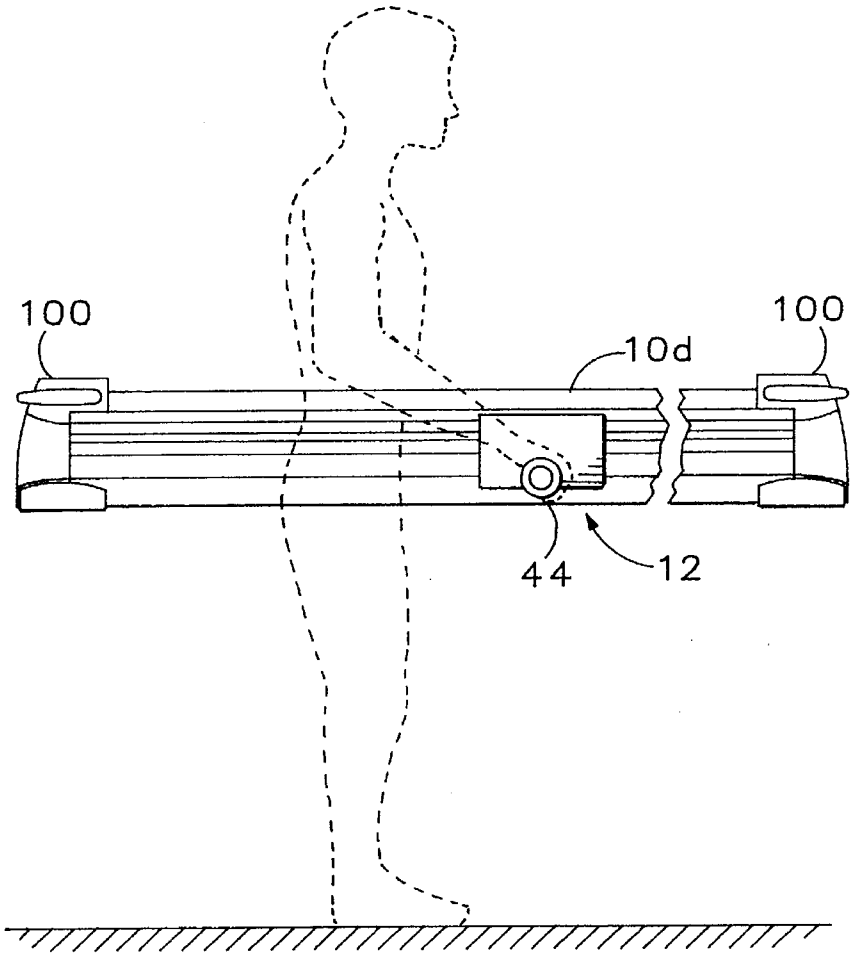
FIG. 4A is a side view of a still further embodiment of the invention for aiding a person in traversing a level surface.
Figures 5, 6, 7:
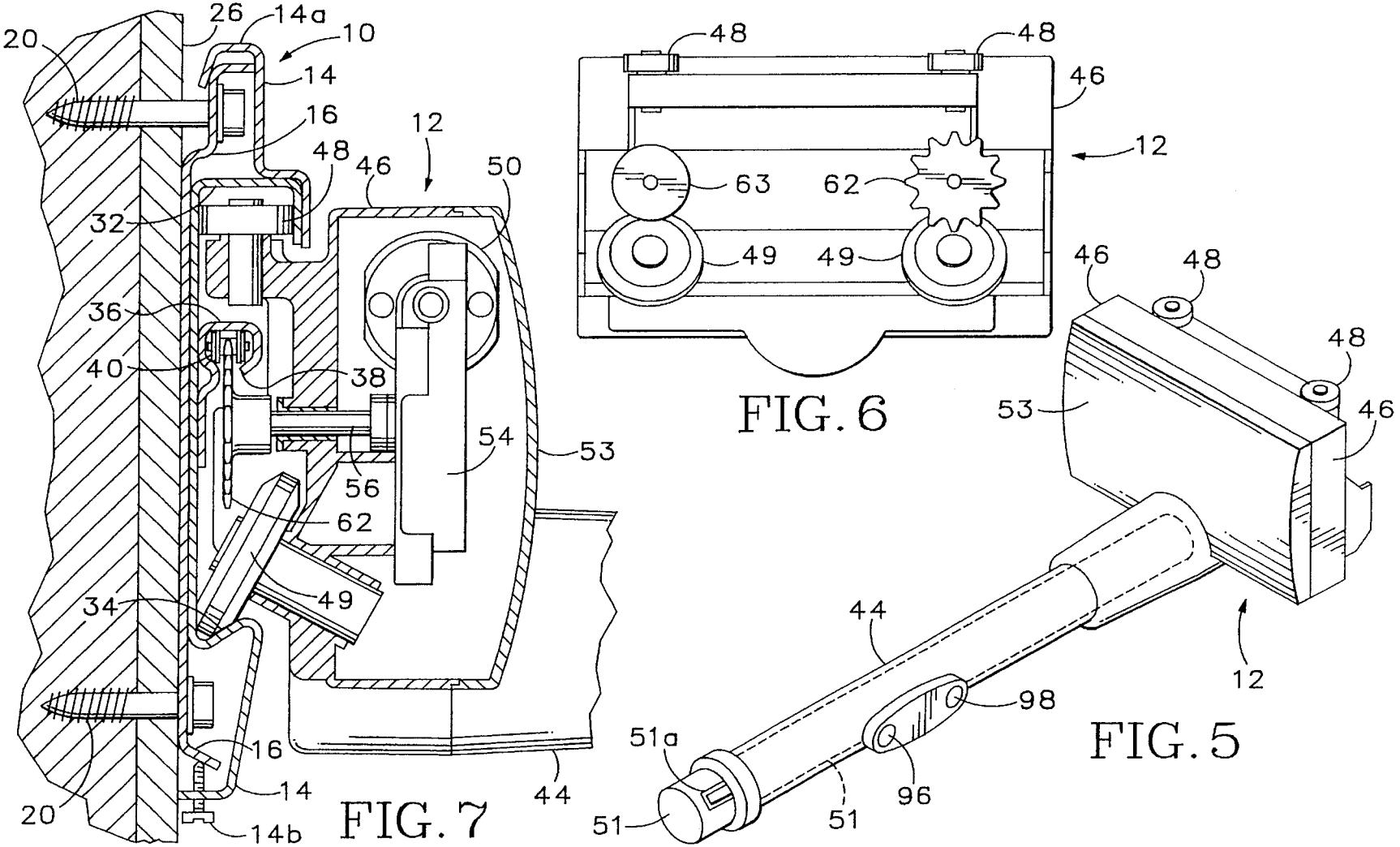
FIG. 5 is an enlarged perspective view of an exemplary embodiment of a portable motorized handgrip used in the embodiments of FIGS. 1, 2, 3, 4 and 4A.
FIG. 6 is an enlarged rear view of the handgrip of FIG. 5.
FIG. 7 is an enlarged sectional view of the handgrip of FIG. 5 in engagement with an exemplary track attached to a wall.

With reference to FIGS. 5–7, the support assembly 12 utilized in each of the embodiments of FIGS. 1–4A is preferably an improved portable, motor-driven, battery-powered unit of the general type shown in U.S. Pat. No. 5,269,227 of the inventors herein, the disclosure of which is hereby incorporated by reference. The assembly 12 comprises a handgrip 44 and a handgrip support 46 having a pair of upper rollers 48 and a pair of lower rollers 49 which interchangeably engage the track assemblies 10, 10*a*, 10*b*, 10*c* and 10*d* selectively in a manner to be described hereafter. The handgrip support 46 further includes a bidirectional electric motor 50 powered by a rechargeable battery pack 51 containing ten 1.2-volt cylindrical batteries in series supported insertably in the handgrip 44 and removable therefrom by depressing a latch 51*a* to withdraw the battery pack. The motor 50 has a conventional worm gear drive assembly 54 with a sufficiently large mechanical advantage that it can only be driven by the motor, and cannot drive the motor. The drive assembly 54 rotates a shaft 56 which drives a sprocket 62, an idler roller 63 being provided in alignment with the sprocket 62. On each of the forward and rearward sides of the handgrip 44 a respective pair of spring-biased push-button switches 96 and 98 (only one pair being shown) is provided to enable the operator to select the proper direction of rotation of the reversible motor 50 and activate it by pushing the appropriate button, regardless of whether the handgrip support 46 is on the right-hand side or the left-hand side of the user. If desired, variable depression of the switches 96 and 98 can produce variable motor speeds.

Figure 2:
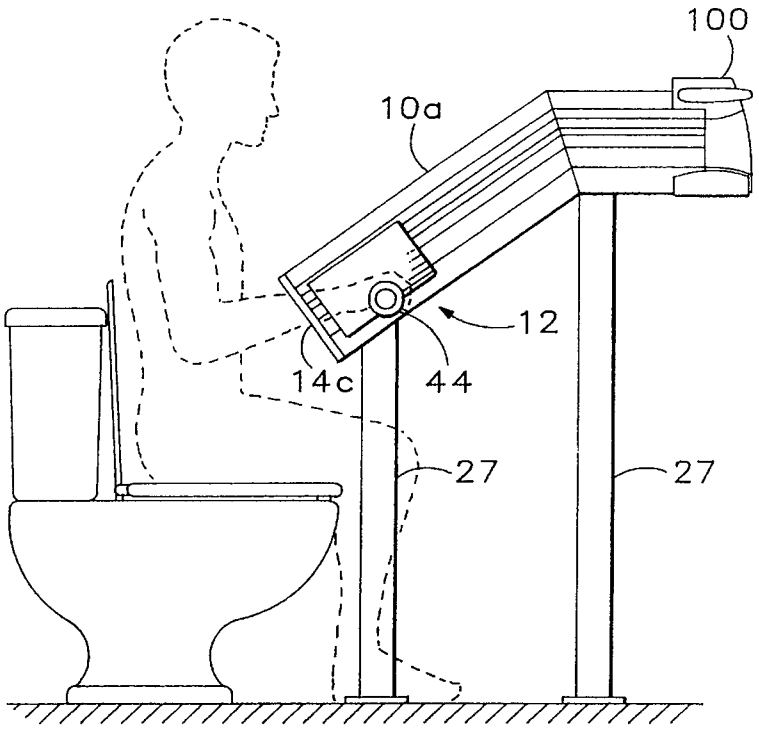
FIG. 2 is a side view of a further embodiment of the invention for aiding a person in moving between a seated and a standing position relative to a toilet.
Figure 1:
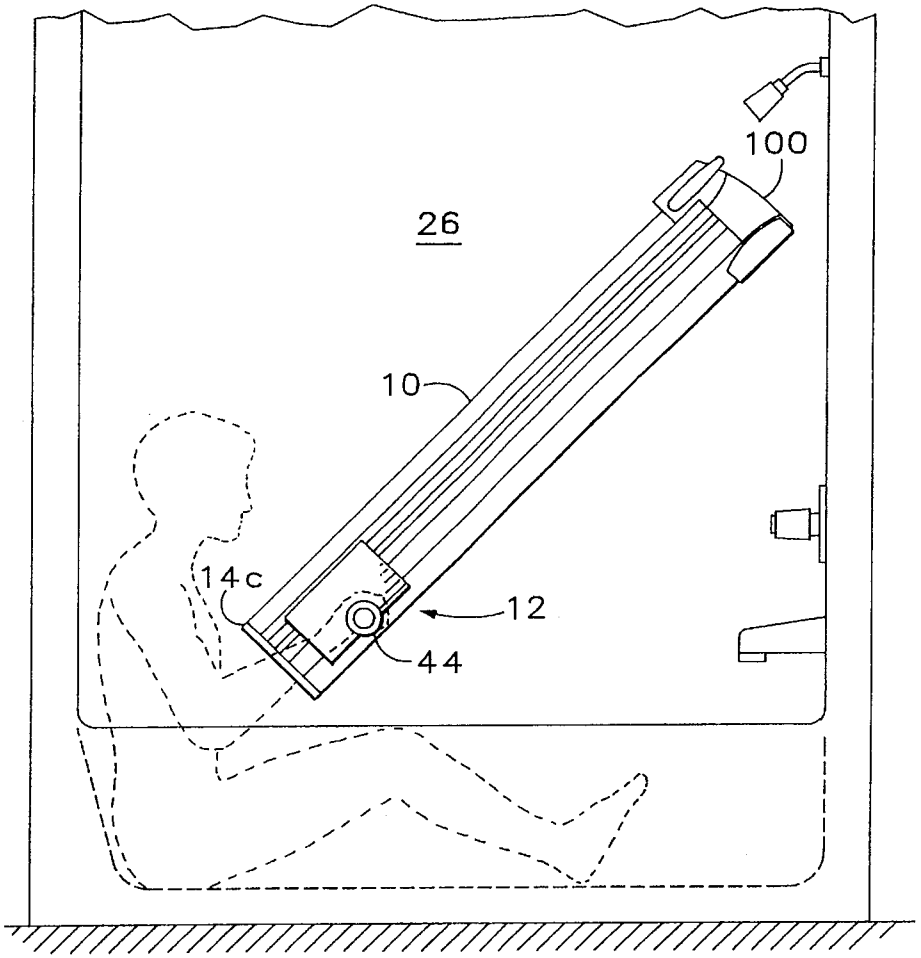
FIG. 1 is a side view of one exemplary embodiment of the present invention for aiding a person in moving between a seated and a standing position relative to a bathtub.

Each of the track assemblies 10, 10*a*, 10*b*, 10*c* and 10*d*, although of different lengths and orientations, has the same cross-sectional configuration shown in FIG. 7. Each track assembly includes an elongate mounting plate 16 which may be fastened by screws 20 to a wall 26 (as also depicted in FIGS. 1 and 4) or, alternatively, to floor-supported posts 27 or other comparable supports as depicted in FIGS. 2 and 3. An elongate track 14 is removably clamped to the support plate 16 by an upper hook portion 14*a* and a lower set of longitudinally-spaced tightening screws 14*b*. Within the track 14 is a longitudinally-extending upper channel 32 for matingly engaging the rollers 48 of the handgrip support 46, and a longitudinally-extending lower channel 34 for matingly engaging the rollers 49. Between the upper channel 32 and lower channel 34 is a longitudinally-extending housing 36 having a downwardly-facing slot 38 therein extending continuously along the length of the housing 36. Within the housing 36 is a longitudinally-extending roller chain 40 affixed to the housing 36 at each of its ends by transverse pins (not shown). Both the sprocket 62 and idler roller 63 are matingly insertable through the slot 38, engaging the chain 40. The idler roller 63 prevents tilting of the handgrip support 46 longitudinally of the track. The teeth on the sprocket 62 drivingly engage the roller chain 40.

The cross section of the track 14 is open on at least one end so as to enable the support assembly 12 to be easily moved detachably onto and off of the end by selective insertion or withdrawal of the rollers 48 and 49, and the sprocket 62 and idler roller 63, through the track's open end. This makes it feasible to use the support assembly 12 transferably with the different tracks 10, 10*a*, 10*b*, 10*c* and 10*d*.

Preferably, the roller chain 40 within the slotted housing 36 does not extend completely to the open end or ends of the track 14. This enables the support assembly 12 to be carried portably to an open end of the track 14 and the rollers 48 and 49 detachably engaged supportably in the opposing channels 32 and 34 by sliding the rollers through the open end without the necessity for simultaneously engaging the drive sprocket 62 with the roller chain 40 and actuating the motor 50. Instead, the channels 32 and 34 are able to provide initial engagement, support and alignment of the support assembly with the track. After this has been accomplished, the user need only push the support assembly slightly further along the track to achieve aligned engagement of the drive sprocket 62 with the recessed end of the roller chain 40. This can be accomplished regardless of whether the track 14 is located on the right- or left-hand side of the user, and regardless of whether the support assembly 12 is inserted in the upper or lower end of the track.

Thereafter, the user can press the appropriate button switch 96 or 98 and begins to move along the track while gripping the support assembly. For example, by pushing the reverse-direction button switch, the user can descend from a standing to a sitting position in a bathtub (FIG. 1), onto a toilet (FIG. 2) or into a chair (FIG. 3). Alternatively, by pressing the forward-direction button switch, the user can rise from these seated positions while gripping the support assembly 12. If desired, for example in connection with moving between a standing and a seated position in a bathtub, a strap or harness (not shown) having looped ends can extend under the user's arms and around his back, with the ends being looped around the handgrip 44.

For purposes of moving between a standing and a sitting position, it is desirable that the lower end of the track not be open, but rather be closed by an insert member such as 14*c* as shown in FIGS. 1–3. An open lower end is unnecessary since the user would normally begin and end his or her use of the support assembly 12 at the upper end of the track. Moreover, the closure of the lower end advantageously prevents any possibility of the assembly 12 inadvertently sliding off of the lower end. In each of FIGS. 1–3, the track assembly 10 is supported rigidly alongside the bathtub, toilet or chair, as the case may be, and supported either by a wall 26 as shown in FIG. 1, floor-mounted posts 27 as shown in FIG. 2, or freestanding floor-supported posts 27 as shown in FIG. 3, the latter being rigidly attached to a plate 27*a* beneath the user's feet which is stabilized by the user's weight and the weight of a chair.

If the support assembly 12 is used in conjunction with a track assembly such as 10*c* or 10*d* mounted alongside a stairway as shown in FIG. 4 or a level surface as shown in FIG. 4A, both ends of the track would preferably be open because of the desirability of transferring the assembly 12 from the track to other tracks located near either end of the track. The user, after engaging the support assembly 12 with either end of the track, can press the appropriate button switch 96 or 98 and begin to ascend or descend a stairway or traverse a level surface such as a hallway while gripping the handgrip.

In the course of moving along the track in any of the previously described uses, the user may move the support assembly 12 in increments along the track by intermittently releasing the button switch 96 or 98 to stop the progress of the support assembly if necessary. When the button switch is released, the assembly 12 is effectively locked to the track by the worm gear drive assembly 54 (or any other equivalent drive structure which prevents the support assembly from moving along the track when the motor is deactivated). Such intermittent driving of the support assembly is particularly useful in negotiating a stairway, so as to stop the progress of the assembly while the user prepares for his next step. The user may also find it helpful intermittently to press the other button switch to reverse the direction of the support assembly momentarily to position it properly for his next step, such as when he has inadvertently moved it too far ahead.

When the support assembly 12 is being driven toward an open end of the track, the drive sprocket 62 will automatically disengage from the roller chain 40 before the rollers 48 and 49 cease to support the assembly on the track, again because of the recessed, inward location of the end of the roller chain 40 relative to the end of the track. Thus, it is impossible for the drive sprocket 62 to drive the support assembly 12 accidentally off the end of the track before the user is ready to detach it and carry it away. Preferably, however, as an added safety feature, each open end of the track also includes a latch assembly 100 for preventing the support assembly 12 from inadvertently slipping off of the end prematurely. With reference to FIGS. 8–11, the latch assembly 100 comprises a frame 102, fastened to an open end of the track 14, having a roller guide 104 with its upper surface aligned with the bottom of the track's lower roller channel 34, and having a latch housing 106 with its lower extremity substantially aligned with the lower extremity of the track's upper roller channel 32. The latch housing 106 has a latch 108 pivotally mounted therein by a pivot pin 110 and biased downwardly by a coil spring 112. Offset from the pivot pin 110, the latch 108 has a triangular aperture 114. A latch release lever 116 pivotally mounted to the front of the latch housing 106 and biased downwardly by a conventional torsion spring 117, has a pin 116*a* extending transversely therefrom through a vertical slot in the latch housing and through the triangular aperture 114 of the latch 108.

Figure 9:
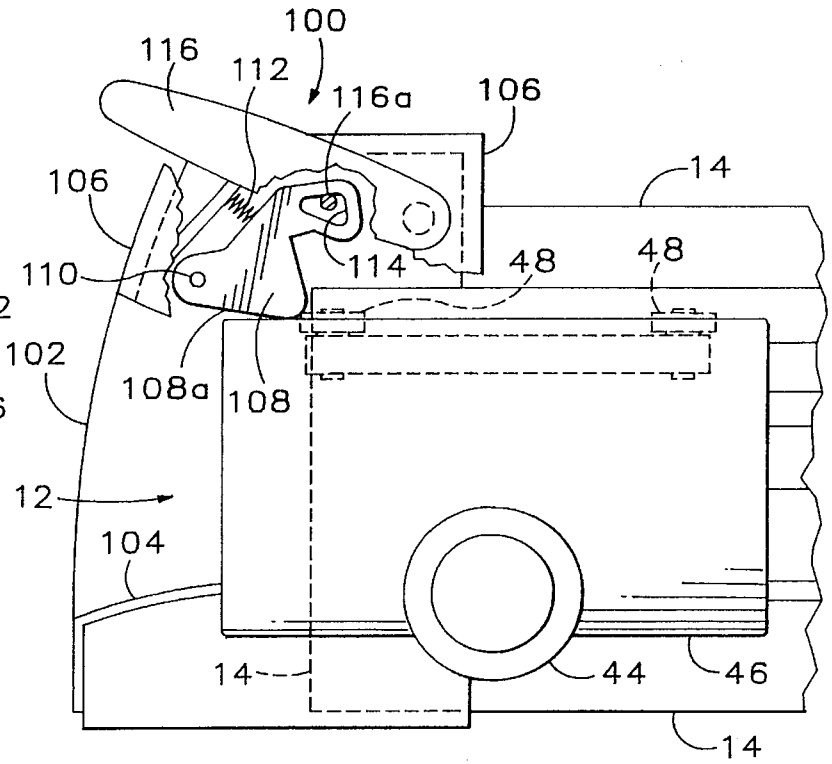
FIGS. 8–11 are partially schematic sequence drawings showing the operation of an exemplary latch assembly on the end of a track in accordance with the present invention.
Figure 8:
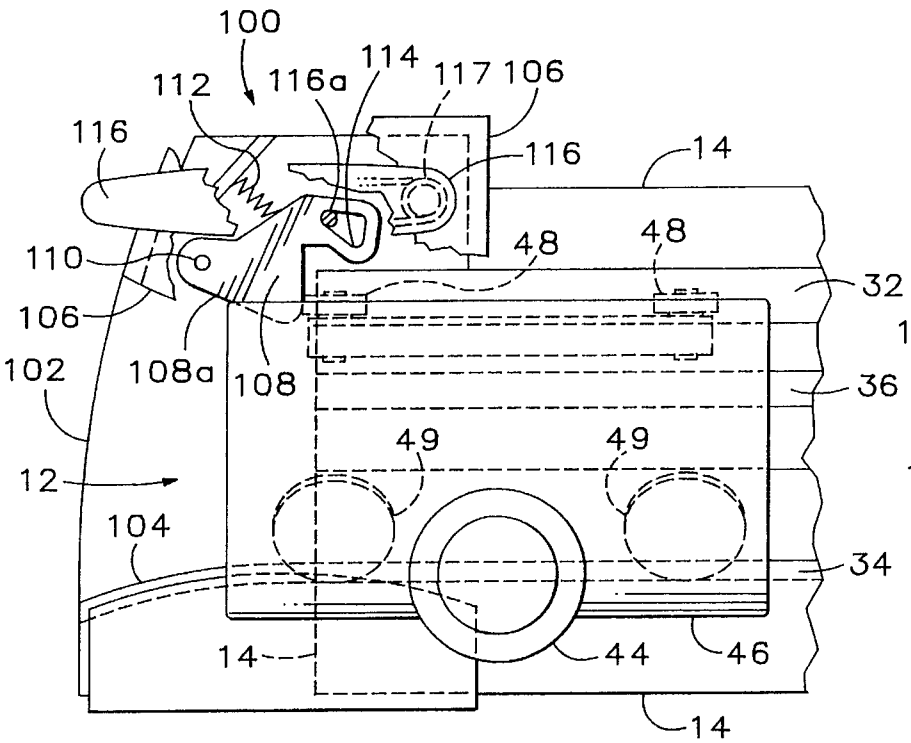
Figure 11:
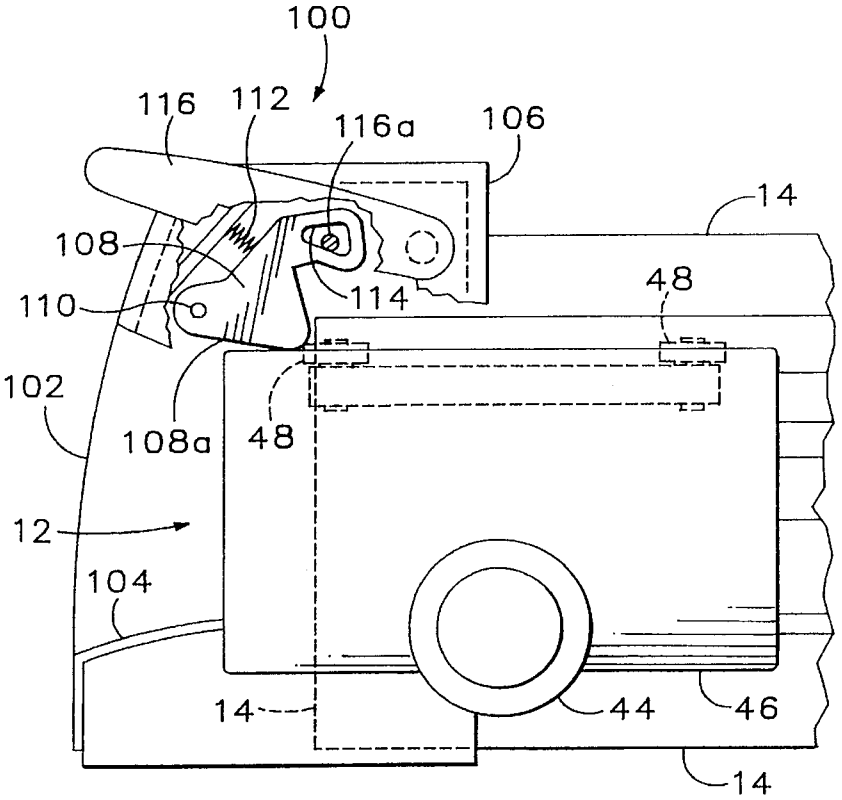
Figure 10:
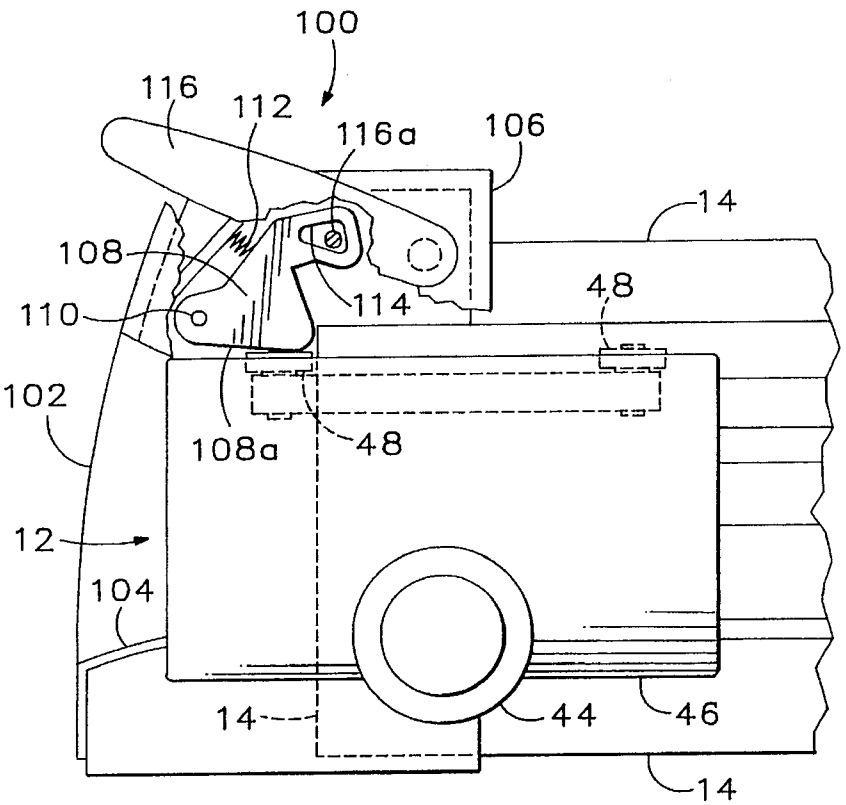

In FIG. 8, the normal spring-biased position of the latch assembly is shown with both the release lever 116 and the latch 108 biased to their downward positions. In this condition, the lower extremity of the latch 108 blocks the open end of the upper channel 32 of the track 14 to prevent the rollers 48 from passing out the end of the channel 32, thereby preventing the support assembly 12 from inadvertently slipping off the open end of the track. However, when it is intended to remove the assembly 12 from the end of the track, the user lifts the release lever 116 upwardly against the force of its biasing torsion spring 117, which causes the lever's pin 116*a* to likewise lift the latch 108 almost, but not completely, out of blocking relationship with respect to the rollers 48 as shown in FIG. 9. Thereafter, by simply pulling the assembly 12 out of the end of the track, the rollers 48 will cam the already-elevated latch 108 slightly higher against the force of the spring 112 as shown in FIG. 10, thereby overcoming a small detent resistance of the latch 108. Alternatively, if the lever 116 is released as shown in FIG. 11 without pulling the assembly 12 out of the track, the lever's torsion spring 117 moves the lever downwardly exerting additional downward force on the latch 108 through the pin 116*a*. This additional downward force on the latch 108 will cam the rollers 48 back into the track channel 32 so that the latch returns to the blocking position of FIG. 8.

When initially engaging the support assembly 12 with an open end of the track through a latch assembly 100, no lifting of the latch release lever 116 is necessary. Merely the act of moving a lower roller 49 toward the bottom track channel 34 over the upper surface of the roller guide 104 will cause the corresponding upper roller 48 to engage the bottom surface 108*a* of the latch 108 and automatically lift the latch 108 out of its blocking relationship to the channel 32.

It is preferred, for reasons of economy, that the drive motor 50 be mounted on the portable support assembly 12. Alternatively, the provision of a motor-driven continuous roller chain on the track assembly, trained around respective motor-driven and idler sprockets near the respective ends of the track assembly and detachably engageable and disengageable by fixed teeth on a portable support assembly, would be feasible for some applications and is within the scope of the present invention. As a further alternative, the hand-grip 44 or comparable upper body support member could detachably engage a motorized trolley which is driven along the track and is a permanent part of the track.

Power for any version of the system can be supplied by a battery or batteries carried on or in the portable assembly 12, as shown, or carried separately by the user in a vest or other convenient holder. Alternatively, if desired, the track assembly can include an AC or transformed DC power source with conductors along the length of the track which slidably or otherwise detachably engage contacts on the portable unit 12 to complete circuits through the control switches and/or motor carried by the portable unit. The latter alternative subtracts the weight of the battery from the portable unit and avoids any possibility of a depleted power source, but adds cost to the original installation.

If desired, the handgrip 44 can be pivotable upwardly or downwardly relative to the handgrip support 46 as shown in the aforementioned U.S. Pat. No. 5,269,227 to retract it from its normally canti-levered position and thereby enable free passage alongside the track even though the support assembly 12 is engaged with the track.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of moving with the aid of an upper body support assembly, said method comprising:

(a) providing a longitudinally-extending elongate track;

(b) providing a portable upper body support assembly, and a motor for driving said support assembly along said track;

(c) carrying said support assembly to said track and engaging said support assembly with said track;

(d) actuating said motor and thereby driving said support assembly along said track while supporting the upper body on said support assembly and thereby moving between different positions along said track; and (e) selectively disengaging said support assembly from said track and carrying said support assembly away from said track.

2. The method of claim 1 wherein step (c) further includes carrying said motor to said track as part of said upper body support assembly and detachably engaging said motor drivingly with said track, and wherein step (e) further includes disengaging said motor from said track and carrying said motor away from said track as part of said support assembly.

3. The method of claim 1 wherein step (d) includes positioning the upper body transversely alongside said track.

4. The method of claim 1 wherein step (d) includes moving between a seated and a standing position.

5. The method of claim 4 wherein step (a) includes providing said track in a position sloping longitudinally alongside a toilet.

6. The method of claim 4, wherein step (a) includes providing said track in a position sloping longitudinally alongside a chair.

7. The method of claim 4, wherein step (a) includes providing said track in a position sloping longitudinally alongside a bathtub.

8. The method of claim 1 wherein step (d) includes moving along a stairway, and step (a) includes providing said track in a position sloping longitudinally alongside said stairway.

9. The method of claim 1 wherein step (d) includes moving along a level surface, and step (a) includes providing said track in a position extending horizontally alongside said level surface.

10. The method of claim 1, further including providing a longitudinally-extending elongate further track, carrying said support assembly to said further track, engaging said support assembly movably and detachably with said further track, and providing a motor for driving said support assembly along said further track.

11. The method of claim 1, further including providing said support assembly in the form of a handgrip.

12. A method of moving between a seated and standing position with the aid of an upper body support assembly, said method comprising:

(a) providing a longitudinally-sloping elongate track;

(b) movably mounting an upper body support assembly on said track, and providing a motor for driving said support assembly along said track;

(c) actuating said motor and thereby driving said support assembly along said track between respective upper and lower positions thereon while supporting the upper body on said support assembly and moving between said seated and said standing position; and (d) selectively disengaging said support assembly from said track and carrying said support assembly away from said track after step (c).

13. The method of claim 12, further including disengaging said motor from said track and carrying said motor away from said track as part of said upper body support assembly.

14. The method of claim 12, further including providing a longitudinally-extending elongate further track, carrying said support assembly to said further track, engaging said support assembly movably and detachably with said further track, and providing a motor for driving said support assembly along said further track.

15. The method of claim 14, further including providing said further track in a position sloping longitudinally alongside a stairway.

16. Apparatus for assisting a person in moving between a seated and a standing position with the aid of an upper body support assembly, said apparatus comprising:

(a) support means for supporting said person in a seated position with said person's legs extending forwardly from said support means;

(b) an elongate track sloping longitudinally forwardly and upwardly from said support means in a position transversely alongside said support means;

(c) an upper body support assembly movably mounted on said track and extending transversely therefrom;

(d) motor means for driving said support assembly along said track between respective upper and lower positions thereon;

(e) engagement means on said track for selectively detachably engaging and disengaging said support assembly with respect to said track, and for selectively detachably engaging and disengaging said motor means drivingly with respect to one of said track and support assembly; and (f) a longitudinally-extending elongate further track having engagement means for selectively detachably engaging and disengaging said support assembly with respect to said further track.

17. The apparatus of claim 16 wherein said further track is in a position sloping longitudinally alongside a stairway.

* * * * *